United States Patent [19]

Lagerstrand

[11] Patent Number: 4,969,479

[45] Date of Patent: Nov. 13, 1990

[54] DISHWASHER

[75] Inventor: Dan E. Lagerstrand, Jonkoping, Sweden

[73] Assignee: Aktiebolaget Electrolux, Stockholm, Sweden

[21] Appl. No.: 424,407

[22] Filed: Oct. 20, 1989

[30] Foreign Application Priority Data

Oct. 21, 1988 [SE] Sweden ..... 8803778

[51] Int. Cl.[5] ..... A47L 15/42

[52] U.S. Cl. ..... 134/108; 134/111; 210/106; 210/409

[58] Field of Search ..... 134/104.1, 104.4, 106, 134/108, 111; 68/18 F; 210/106, 409

[56] References Cited

FOREIGN PATENT DOCUMENTS

| | | | |
|---|---|---|---|
| 1206125 | 12/1965 | Fed. Rep. of Germany | 134/111 |
| 2413790 | 10/1975 | Fed. Rep. of Germany | 134/104.1 |
| 2614949 | 10/1977 | Fed. Rep. of Germany | 134/111 |
| 2656556 | 6/1978 | Fed. Rep. of Germany | 134/111 |
| 589092 | 2/1925 | France | 134/111 |
| 2332738 | 6/1977 | France | 134/104.4 |

*Primary Examiner*—Philip R. Coe

*Attorney, Agent, or Firm*—Pearne, Gordon, McCoy & Granger

[57] ABSTRACT

A dishwasher comprising a washing tub (18), conduits for supplying liquid by jets on articles to be washed in the tub, and surfaces for recollecting the liquid in a receptacle. A circulation pump is arranged to circulate liquid in a system comprising a liquid supplying conduit and a filter unit comprising a fine sieve portion (12*a*) having a wide, mainly horizontal surface. The horizontal fine sieve portion forms an upper wall for a chamber (11) in which inlet of the circulation pump as well as a heating element (15) for heating the liquid in the receptacle is placed. There is a connecting tube (17) extending through the fine sieve portion (12*a*) and having an upper end (17*b*) which is placed above the highest liquid level in the tub during normal operation whereas the lower end (17*a*) of the connecting tube is placed in the chamber (11) at a point which is so situated that the heating element during operation always is surrounded by liquid.

10 Claims, 2 Drawing Sheets

DISHWASHER

BACKGROUND OF THE INVENTION

The invention relates to dishwashers, and more particularly to those having a heating element for heating washwater located beneath the washing tub.

In dishwashers of the type placed on the floor and usually provided with two rotating wash arm within a washing tub it is common that the heating elements which are necessary for heating the washwater are mounted close to the bottom of the washing tub. In dishwashers which are placed on a work top or otherwise supported above the floor the space in the washing tub is more limited and usually it is only possible to arrange one single rotating wash arm therein which, by means of jets, applies dishwashing liquid on the articles to be washed. This wash arm is preferably placed adjacent the bottom of the washing tub, and in order not to disturb the movement of the wash arm, the heating element is arranged below the bottom of the washing tub, preferably in a receptacle adjacent the water outlet of the machine. The receptacle is divided into a circulation chamber and an outlet chamber separated by a fine sieve. The suction side of a circulation pump is connected to the circulation chamber. The receptacle is also covered by fine sieve over its upper portion adjacent the washing tub.

It has been discovered in dishwashers having the heating element situated at a low level that the liquid which should flow back to the receptacle by means of he fine sieve in order to be heated again is, to a great extent, guided over the fine sieve rather than through it. This means that the liquid level in the receptacle decreases to a level where the liquid does not surround the heating element thereby causing a risk of overheating.

It has been established that the phenomena described above results because when the heating element is activated a vapor pressure is built up between the liquid in the receptacle and the fine sieve thereby preventing liquid from flowing down into the receptacle through the openings in the fine sieve.

SUMMARY OF THE INVENTION

One feature of the preferred embodiment of the invention is to provide a means where the effect of the vapor pressure is eliminated or at least reduced.

The preferred embodiment of the invention provides an evacuation pipe vertically disposed within the substantially horizontal fine sieve covering the circulation chamber. The upper end of the evacuation pipe extends into the washing tub and is maintained at a position which is always above the highest level of liquid within the washing tub during the washing cycle. The lower end of the evacuation pipe extends into the circulation chamber and is disposed between the fine sieve and the heating element.

When the heating element is activated the temperature of the liquid contained in the circulation chamber increases causing the vapor pressure between the surface of the liquid in the chamber and the fine sieve to increase thereby decreasing the flow rate of liquid through the fine sieve into the chamber causing the liquid level in the chamber to lower. When the liquid level reaches a point below the lower end of the evacuation pipe the vapor pressure equalizes and the liquid above the fine sieve is again able to pass into the circulation chamber. When the pressure is equalized the rate of liquid flow into the circulation chamber exceeds the rate of liquid flow out of the chamber thereby allowing the liquid level in the chamber to rise.

DETAILED DESCRIPTION OF THE PREFERRED EMBODIMENT

Figure 1:
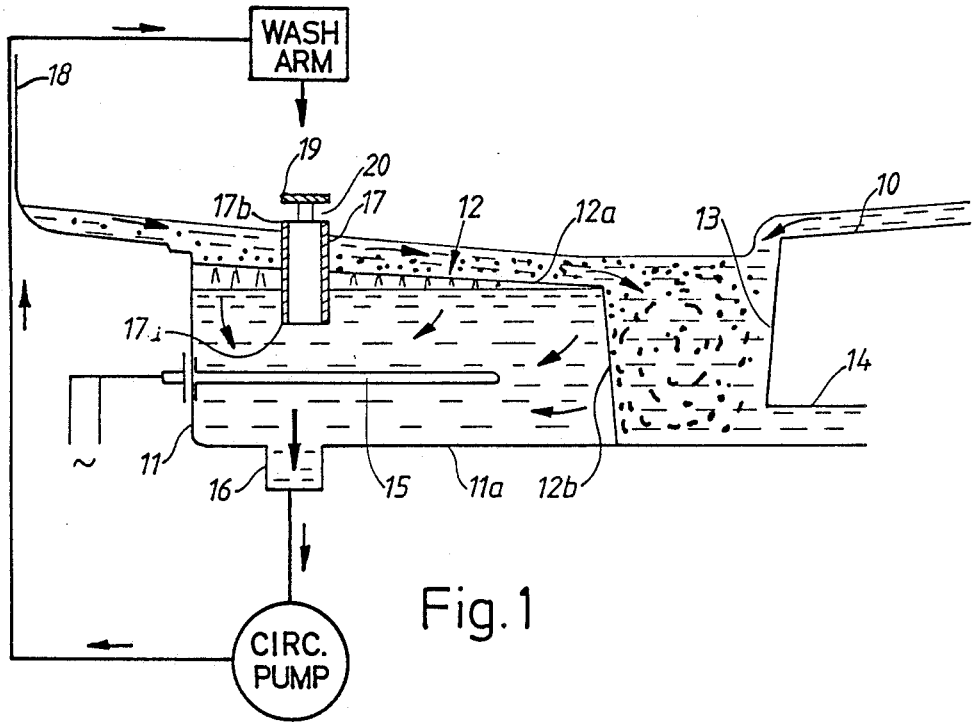
FIGS. 1–4 diagrammatically show a vertical section of the bottom part of a dishwasher according to the invention during different operation conditions.

In a dishwasher which is not shown in detail there is a bottom plate 10 having a receptacle divided into a circulation chamber 11, covered and limited by a fine sieve 12, and a outlet chamber 13 which is provided with an upwardly open, box like removable coarse sieve. The fine sieve 12 has a substantially horizontal portion 12*a* defining an upper wall of the chamber 11, and a vertical portion 12*b* separating the circulation chamber 11 and the outlet chamber 13. The outlet chamber 13 is connected through a conduit 14 to an outlet pump, not shown, which empties the machine after the washing operation. An electric heating element 15 is arranged in the chamber 11 and extends horizontally near the center of the chamber. At the bottom 11*a* of the chamber 11 is a conduit 16 connected to the suction side of a circulation pump. In the fine sieve portion 12*a* there is a vertical evacuation pipe 17 having a lower end 17*a* is placed in the chamber 11 between the heating element 15 and the fine sieve portion 12*a*. The upper end 17*b* of the evacuation pipe 17 is placed in the washing tub 18 above the highest liquid level prevailing in the machine during the washing cycle. In order to prevent the function of the evacuation pipe 17 from being interrupted by jets of water falling therein from a wash arm the upper end 17*b* of the pipe 17 is provided with a cover 19 placed a distance from the end 17 *b* of the pipe 17 thereby creating an opening 20.

The operation of the dishwasher will be described by reference to the Figures. Referring to FIG. 1, there is shown a dishwasher in operation when liquid from the circulation pump is directed through conduit 16 to the wash arm and from there, via the articles to be washed and the walls of the tub, to the bottom plate 10 of the dishwasher. Since the plate 10 slopes towards the fine sieve 12 the liquid flows over and through sieve 12 whereby food particles are deposited on the horizontal portion 12*a* of the fine sieve 12 whereas larger food particles are collected in the outlet chamber 13. The larger food particles are prevented from reaching the circulation chamber 11 by means of the fine sieve portion 12*b*. During this portion of the washing cycle the heating element 15 is not activated.

Figure 2:
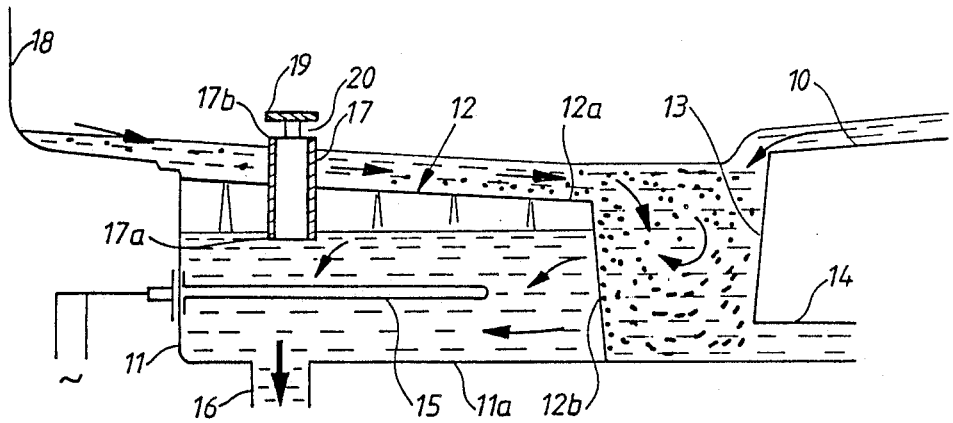

Referring to FIG. 2, the heating element 15 has been activated and begins to warm the liquid in the receptacle. As the temperature gradually rises in the chamber 11 the vapor pressure increases between the liquid surface in the chamber 11 and the fine sieve portion 12*a* which decreases the flow of liquid through the fine sieve portion 12*a*. The liquid instead flows over the fine sieve portion 12*a* and is re-collected in the outlet chamber 13 from which it is directed into the chamber 11 through the fine sieve portion 12*b*. The liquid flow on the upper side of the fine sieve portion 12*a* is advantageous because the sieve 12 is rinsed of food particles which instead are directed to the outlet chamber 13.

Figure 3:
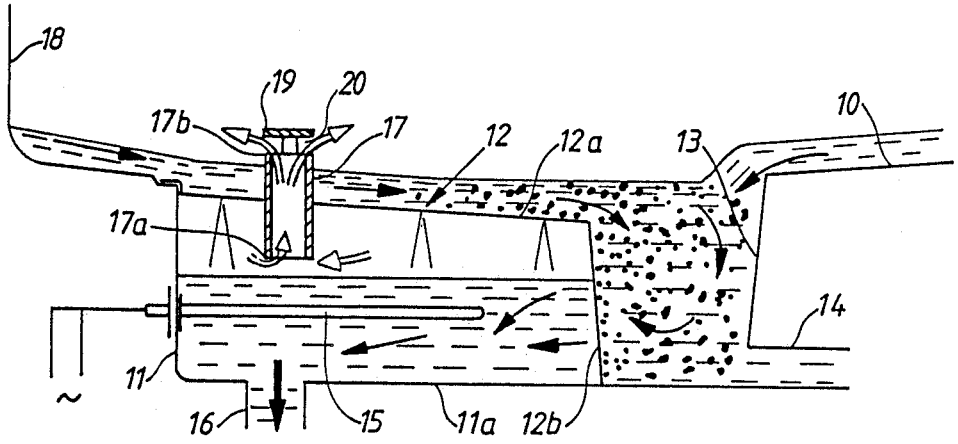

Referring to FIG. 3, during this portion of the washing cycle the vapor pressure has reached such a value that the liquid surface has fallen below the lower end 17*a* of the evacuation pipe 17. A pressure equalizing takes place and the liquid can again pass through the fine sieve portion 12*a* so that the chamber 11 again is filled with liquid. The rate of flow into the chamber 11 exceeds that which the circulation pump empties the chamber 11. Thus, the level in the chamber 11 rises and the vapor pressure above the liquid surface increases again.

Figure 4:
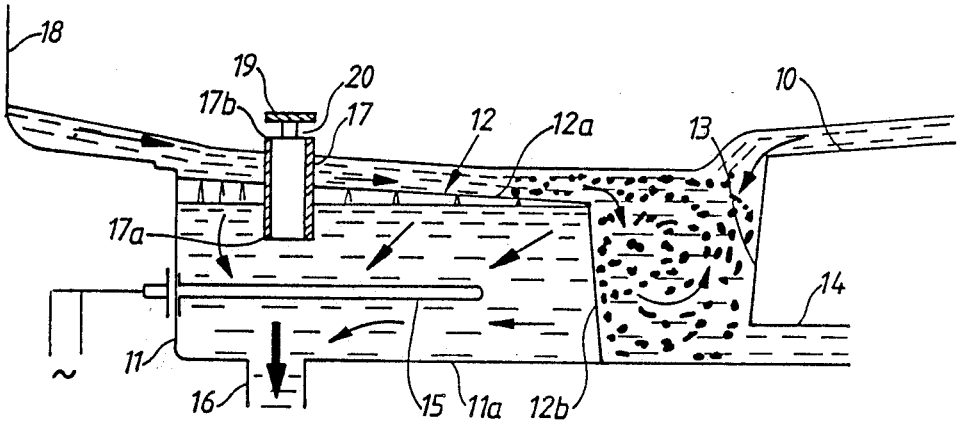

Referring to FIG. 4, there is shown the liquid at its normal level below the fine sieve portion 12*a* after the pressure equalization has occurred. At the same time that the liquid reaches this level the vapor pressure has not yet increased enough to restrict the liquid flow through the fine sieve portion 12*a*. As long as the heating element is activated the liquid level will fluctuate between these high and low levels which means that liquid from time to time will flow over the fine sieve portion 12*a* and rinse food particles therefrom. When the dishwashing operation is finished and the outlet pump has started and removes the dishwashing liquid, food particles which have passed through the coarse sieve are removed with the liquid from the outlet chamber 13. Because of the regular fine sieve rinsing operations the subsequent washing or rinsing operation starts with a clean fine sieve.

Although the preferred embodiment of this invention has been shown and described, it should be understood that various modifications and rearrangements of the parts may be resorted to without departing from the scope of the invention disclosed and claimed herein.

What I claim is:

1. A dishwasher comprising a washing tub (18), means for supplying liquid by jets onto articles to be washed in the washing tub, and means for recollecting the liquid in a receptacle, a circulation pump for circulating the liquid in a system comprising liquid supplying means and a filter unit comprising a fine sieve portion (12*a*) having a wide, mainly horizontal surface defining an upper wall for a chamber (11) in which an inlet of said circulation pump and a heating element (15) for heating the liquid in the receptable is located wherein a connecting means (17) extends through the fine sieve portion (12*a*) and has an upper end (17*b*) maintained above the highest liquid level in the washing tub during normal operation, said connecting means (17) having a lower end (17*a*) located in said chamber (11) at a point above said heating element which is so situated that said heating element (15) is continuously surrounded by liquid during operation, said lower end (17*a*) being located so as to permit vapors to escape therethrough without going through said inlet when vapor pressure inside said chamber (11) forces the liquid level within said chamber (11) below said lower end (17*a*).

2. A dishwasher comprising a washing tub (18), means for supplying liquid by jets onto articles to be washed in the washing tub, and means for recollecting the liquid in a receptacle, a circulation pump for circulating the liquid in a system comprising liquid supplying means and a filter unit comprising a fine sieve portion (12*a*) having a wide, mainly horizontal surface defining an upper wall for a chamber (11) in which an inlet of said circulation pump and a heating element (15) for heating the liquid in the receptable is located wherein a connecting means (17) extends through the fine sieve portion (12*a*) and has an upper end (17*b*) maintained above the highest liquid level in the washing tub during normal operation, said connecting means (17) having a lower end (17*a*) located in said chamber (11) at a point above said heating element which is so situated that said heating element (15) is continuously surrounded by liquid during operation, said inlet of said circulation pump being located at the bottom (11*a*) of the chamber (11) and said connecting means (17) being substantially coaxial with and above said inlet.

3. A dishwasher comprising a washing tub (18), means for supplying liquid by jets onto articles to be washed in the washing tub, and means for recollecting the liquid in a receptacle, a circulation pump for circulating the liquid in a system comprising liquid supplying means and a filter unit comprising a fine sieve portion (12*a*) having a wide, mainly horizontal surface defining an upper wall for a chamber (11) in which an inlet of said circulation pump and a heating element (15) for heating the liquid in the receptacle is located wherein a connecting means (17) extends through the fine sieve portion (12*a*) and has an upper end (17*b*) maintained above the highest liquid level in the washing tub during normal operation, said connecting means (17) having a lower end (17*a*) located in said chamber (11) at a point above said heating element which is so situated that said heating element (15) is continuously surrounded by liquid during operation, said chamber (11) having a bottom (11*a* ) and being generally rectangular and having connected therein said heating element (15), said heating element (15) being elongated and disposed substantially parallel to said bottom (11*a*) of said chamber (11) and located approximately half-way between said bottom (11*a*) and said fine sieve portion (12*a*), said lower end (17*a*) of said connecting means (17) located in the chamber (11) at a point approximately half-way between said fine sieve portion (12*a*) and said heating element (15).

4. A dishwasher as recited in claim 2, wherein said chamber (11) is generally rectangular and has connected therein said heating element (15), said heating element (15) being elongated and disposed substantially parallel to said bottom (11*a*) of said chamber (11) and located approximately half-way between said bottom (11*a*) and said fine sieve portion (12*a*), said lower end (17*a*) of said connecting means (17) located in the chamber (11) at a point approximately half-way between said fine sieve portion (12*a*) and said heating element (15).

5. A dishwasher as recited in claim 4, wherein said connecting means (17) is a tube.

6. A dishwasher as recited in claim 5, wherein said upper end (17*b*) of said connecting means (17) is provided with a cover (19) situated a distance from said upper end (17*b*), said cover (19) and said upper end (17*b*) forming therebetween at least one opening (20) which is substantially horizontal.

7. A dishwasher as recited in claim 2, wherein said connecting means (17) is a tube.

8. A dishwasher as recited in claim 7, wherein said upper end (17*b*) of said connecting means (17) is provided with a cover (19) situated a distance from said upper end (17*b*), said cover (19) and said upper end (17*b*) forming therebetween at least one opening (20) which is substantially horizontal.

9. A dishwasher as recited in claim 3, wherein said connecting means (17) is a tube.

10. A dishwasher as recited in claim 9, wherein said upper end (17*b*) of said connecting means (17) is provided with a cover (19) situated a distance from said upper end (17*b*), said cover (19) and said upper end (17*b*) forming therebetween at least one opening (20) which is substantially horizontal.

* * * * *